US005726646A

United States Patent [19]

Bane et al.

[11] Patent Number: 5,726,646

[45] Date of Patent: Mar. 10, 1998

[54] METHOD AND APPARATUS FOR ACTIVATING AND ACCESSING REMOTE METER INTERFACE DEVICES

[75] Inventors: Ronald L. Bane, Stone Mountain; James M. Barlow, Lawrenceville, both of Ga.

[73] Assignee: Motorola, Inc., Schaumburg, Ill.

[21] Appl. No.: 589,718

[22] Filed: Jan. 22, 1996

Related U.S. Application Data

[63] Continuation-in-part of Ser. No. 223,417, Apr. 4, 1994, abandoned.

[51] Int. Cl.[6] ..... G08C 17/00

[52] U.S. Cl. ..... 340/870.03; 340/870.11; 340/505; 340/825.54; 455/38.3

[58] Field of Search ..... 340/870.02, 870.03, 340/870.11, 505, 825.44, 825.54, 825.47; 455/38.2, 38.3, 56.1, 343

[56] References Cited

U.S. PATENT DOCUMENTS

| | | | |
|---|---|---|---|
| 4,614,945 | 9/1986 | Brunius et al. | 340/870.03 |
| 4,860,005 | 8/1989 | Deluca et al. | 340/825.44 |
| 4,894,649 | 1/1990 | Davis | 340/825.44 |
| 4,964,121 | 10/1990 | Moore | 455/343 |
| 4,996,526 | 2/1991 | Deluca | 340/825.44 |
| 5,109,530 | 4/1992 | Stengel | 455/38.3 |
| 5,461,558 | 10/1995 | Patsiokas et al. | 340/870.03 |
| 5,481,259 | 1/1996 | Bane | 340/870.11 |
| 5,493,287 | 2/1996 | Bane | 340/870.02 |
| 5,631,636 | 5/1997 | Bane | 340/870.03 |

*Primary Examiner*—Jeffery Hofsass
*Assistant Examiner*—Andrew Hill
*Attorney, Agent, or Firm*—Kenneth M. Massaroni

[57] ABSTRACT

A remote meter reading system (10) includes a group of meter interface units operable in an inactive state and periodically activated to monitor a communication channel for activity. Each meter interface unit (12) is responsive to communication signals from a meter reading device (15). The meter reading device (15) initiates communication with a first meter interface unit (12) selected from the group. The meter reading device (15) transmits to the first meter interface unit, a first message including a request for data. The meter reading device (15) then receives transmissions from the first meter interface unit (12) which are governed by a first transmission rule. The meter reading device (15) determines when at least a second meter interface unit (12) is operating in an active state, and transmits to the first meter interface unit (12), a second message including a specifier for a second transmission rule.

19 Claims, 4 Drawing Sheets

METHOD AND APPARATUS FOR ACTIVATING AND ACCESSING REMOTE METER INTERFACE DEVICES

CROSS REFERENCE TO RELATED APPLICATIONS

This application is a continuation-in-part of U.S. application Ser. No. 08/223,417, filed Apr. 4, 1994, by Bane, Ronald L.; and Barlow, James M., entitled "METHOD AND APPARATUS FOR ACTIVATING AND ACCESSING REMOTE METER INTERFACE DEVICES," and assigned to Motorola, Inc. now abandoned.

TECHNICAL FIELD

This invention relates in general to remote meter reading systems, and more specifically, to activating and accessing meter interface devices in a remote meter system.

BACKGROUND

There has been a strong interest on the part of utility companies, and similar entities, to take advantage of modern technology to reduce costs and increase efficiency in meter reading applications. Traditionally, meters, such as electric, water, and gas meters, have been manually read by a person physically located at each meter. However, recent developments have provided for meters which can be remotely accessed from a central location through wire or wireless communication links. Oftentimes, these remotely accessible meters have battery powered meter interface devices which can access the meter status information, and which can communicate via radio frequency signals the meter status information to a remotely situated meter reading device. In such cases, issues associated with power consumption management are an important concern in a remote meter reading system since the meter interface devices in the system are typically battery operated.

In a typical operational environment, a meter reading system includes a large number of meter installations. Low maintenance battery-operated meters are desirable to facilitate operating efficiency and to reduce maintenance costs. Therefore, it is desirable to have a meter interface device which can operate for an extended period of time without requiring frequent maintenance for battery replacement and the like. Such maintenance requirements may be reduced by increasing battery capacity or by reducing power consumption. The more viable option of reducing power consumption at the battery powered meter interface device is usually pursued. For example, the meter interface device may be placed in a sleep or low power operating mode when there is no ongoing communication with a meter reading device. A trade off is usually made between the availability of the meter interface device for communications with the meter reading device and the amount of power consumption savings which can be achieved. A meter interface device employing a power consumption saving technique may not be able to communicate with the remote meter reading device as its communication circuitry or sections thereof may be shut-off when the device is in the sleep mode in order to conserve battery energy.

There exists a need for a meter reading system in which meter interface devices, operable in a power consumption saving mode, can be accessed in a time efficient manner while facilitating the power conservation features of these devices.

DETAILED DESCRIPTION OF THE PREFERRED EMBODIMENT

Generally, the present invention provides for a remote meter reading system including a remote meter reading device, or master unit, and a group of remotely located meter interface units, or target units. The meter reading device and the remotely situated meter interface units are capable of communicating with each other. In this meter reading system, the remote meter interface units have a power consumption management system which allows each meter interface unit to operate in a reduced power consumption mode (also known as a sleep or inactive mode). The remote units achieve power consumption savings by alternating between active and inactive states. While in an inactive state there is no communication capability in the preferred embodiment. However, the remote units are periodically activated to enable communications capabilities, and during such period, the remote units are responsive to communication signals initiated by the remote meter reading device.

Figure 1:
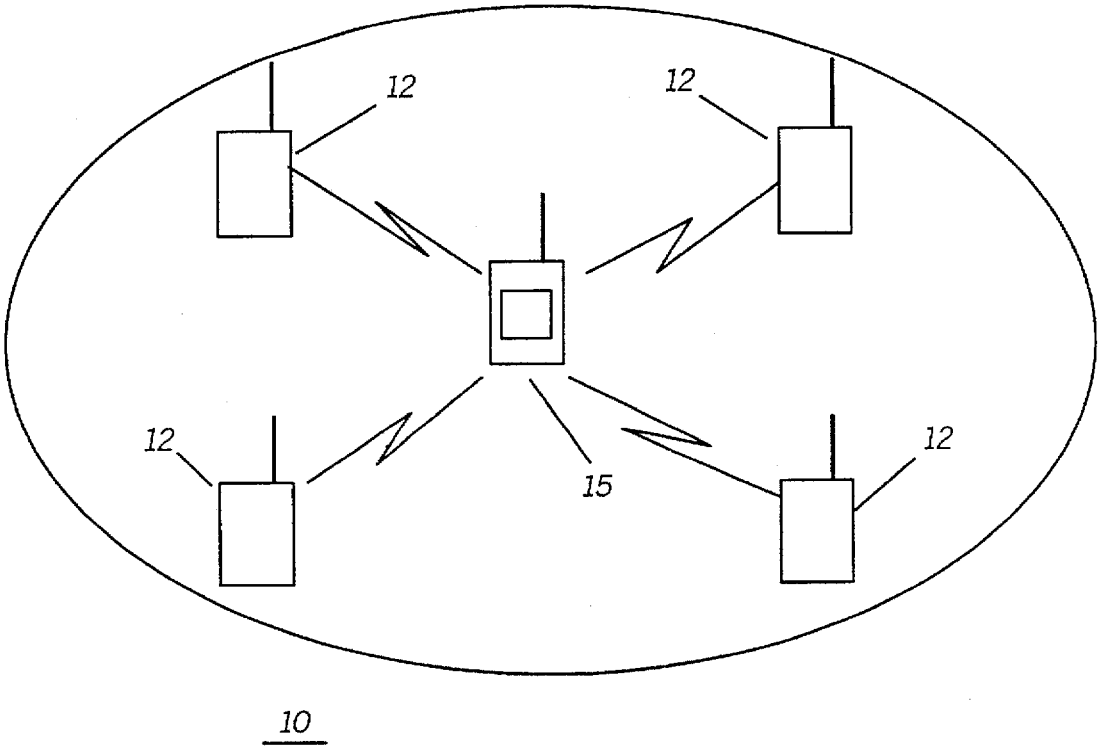
FIG. 1 shows a representation of a remote meter reading system, in accordance with the present invention.

Referring now to the drawings and specifically to FIG. 1, there is shown a representation of a remote meter reading system 10 in accordance with the present invention. The system includes at least one meter reading device 15, and a group of remotely located meter interface units 12. The meter reading device 15 is situated such that it is in within communication range of the group of meter interface units 12.

Figure 2:
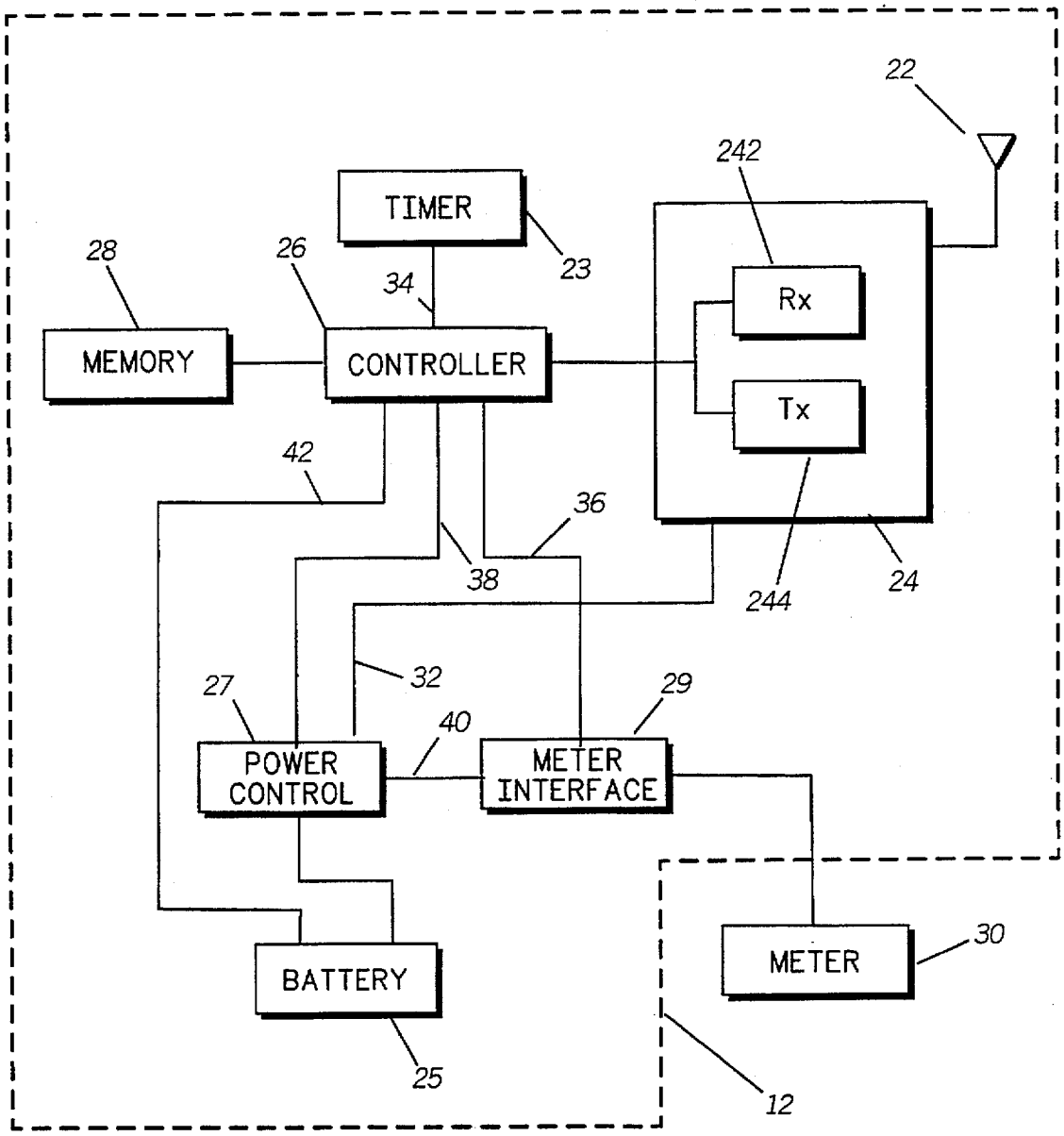
FIG. 2 shows a block diagram of a meter interface unit attached to a meter, in accordance with the present invention.

In FIG. 2, a block diagram of a meter interface unit 12 is shown in accordance with the present invention. The meter interface unit 12 provides an interface for reading a meter 30, such as an electricity meter, a water meter, a gas meter, or other similar devices. Additionally, the meter interface unit 12 provides remote access to the functions of the meter 30 (e.g., amount of electricity consumption measured by the meter, etc.). The meter interface unit 12 includes a controller 26, memory section 28, a radio frequency transceiver 24, a meter interface portion 29, timer circuit 23, battery 25, and power control section 27. Controller 26 is implemented using a well known microprocessor or microcontroller as known in the art. The meter interface portion 29 is electrically coupled to meter 30 and provides access to the functions of the meter 30. In most applications, meter interface portion 29 takes information from meter 30 and provides the meter information to controller 26 so that it can then send the information to meter reading device. The design of meter interface portion 29 will depend on the type of meter 30 which will be interfaced. Typically, meter interface circuit 29 will comprise a conventional serial digital interface which is used to acquire the digital information provided by meter 30. The power control section 27 controls the battery power supplied from battery 25 to select circuitry in meter interface unit 12, and facilitates the operation of power consumption management. Memory section 28 preferably includes random access memory (RAM), read-only memory (ROM), etc.

Radio frequency (RF) transceiver 24 is capable of receiving and transmitting communication signals over a communication channel, such as a RF channel via antenna 22, using well-known principles. Transceiver 24 can comprise a conventional frequency modulated (FM) transceiver as is well known in the art. The controller 26 uses the information such as software programs, etc. stored in the memory block 28 to control the overall operation of the meter interface unit 12. The controller 26 is electrically coupled to the RF transceiver 24 and provides the overall control for the RF transceiver 24. For receive operations, communication signals are received by the antenna 22 and are selectively processed by the receiver 242. Similarly, for transmit operations, communication signals are processed by the transmitter 244 and radiated through the antenna 22. The memory block 28 can store information received by the meter interface unit 12, such as information sent by meter reading device 15.

The meter interface unit 12 is operable in an inactive or battery saving state to reduce power consumption. In the inactive state, select circuitry in the meter interface unit 12 have battery power to them shut-off, in order to conserve the battery capacity of battery 25. Preferably, meter interface unit 12 is periodically operable in an activated or operational state in order to monitor its RF communication channel for channel activity directed at the meter interface unit 12. The power control circuit 27 responds to a periodic control signal provided by controller 26. Timer circuit 23 provides a conventional time base which communicates with controller 26 via bus 34. Timer circuit 23 activates the controller 26 at specific time intervals, preferably either at 8 or 512 second intervals. Real time is approximated by the controller 26 using this time base provided by timer circuit 23. The power control circuitry 27 is controlled by the controller 26 which also has overall control of meter interface unit 12. Battery power is provided directly to controller 26 via power line 42 since controller 26 has to have power available to it at all times. In order to conserve even more battery energy, controller 26 can also be placed in a reduced current mode (which is available on many conventional microprocessors) during select periods of time.

The controller 26 provides the battery saving control signal to power control circuit 27 via bus 38. Upon receipt of the control signal, the power control circuit 27 supplies power to the transceiver 24 from the electrically coupled battery 25 via power bus 32. When the control signal is removed, battery 25 is disconnected from transceiver 24, thereby reducing the meter interface unit's current drain. Controller 26 communicates with power control circuit 27 via bus 38, while it communicates with meter interface circuit 29 via bus 36. Battery energy is supplied from battery 25 to controller 26 via power bus 42 and to meter interface unit 29 via power bus 40. Energy conservation is realized by disconnecting selected circuits from battery power during battery saving periods. In the preferred embodiment, the controller is placed in a standby mode in which power consumption is substantially reduced using the controller's internal power management capabilities.

The meter interface unit 12 is responsive to messages received over the monitored radio frequency communication channel at receiver 242. The received message may include specific commands which require a response from the meter interface unit 12. These commands include wake-up requests or activation signals, meter reading requests (e.g., meter reading device 15 requesting meter data from meter 30, such as how much water consumption has occurred, etc.), and requests for data, etc. A request for data is any message which is interpreted by the meter interface unit 12 as an indication that data is to be transmitted to the meter reading device. The meter interface unit 12 responds to a wake-up request by operating in an activated state for an extended time period. In response to a meter reading request, the meter interface unit 12 communicates with meter 30 through the meter interface portion 29 to extract status information from the meter 30. When the meter interface unit 12 receives a request for data, the response data including the meter status information is transmitted via transmitter 244 to meter reading device 15. The meter reading request and the request for data may be combined as a single request. In the preferred embodiment, the request for data (or meter reading request) is optionally accompanied by a specifier for a transmission rule. A transmission rule establishes constraints, if any, on the meter interface unit 12 relating to transmissions on the communication channel. The specifier may be a reference indicator, which provides information to locate the transmission rule, or the specifier may contain the transmission rule itself. In one embodiment, the transmission rule includes a size limit for a continuous stream of data which may be transmitted on the communication channel. In another embodiment, the transmission rule includes a time limit for continuous transmission on the communication channel, and includes a minimum value for a delay period between successive transmissions. Preferably, the transmission rule is stored in a data storage area accessible by the meter interface unit 12. Alternatively, the transmission rule is transmitted by the meter reading device 15. When the response data cannot be transmitted in a single transmission without violating the transmission rule, the response data is segmented, or parceled, and transmitted in two or more successive transmissions. In another case, the transmission rule may signal or indicate that there are no constraints imposed by the meter reading device 15 on channel transmissions. Thus, data transmission is based at least in part on the transmission rule in force.

Figure 3:
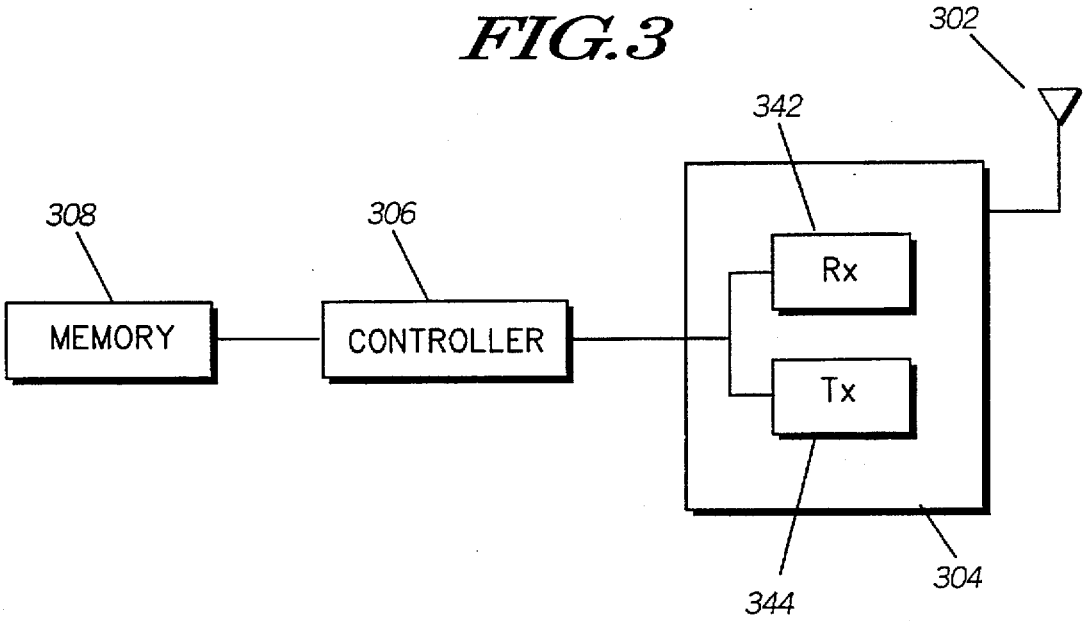
FIG. 3 shows a block diagram of a meter reading device, in accordance with the present invention.

Referring to FIG. 3, a block diagram of a meter reading device 15 is shown in accordance with the present invention. The meter reading device 15 has communication capabilities similar to those described with respect to the meter interface unit 12. Accordingly, the meter reading device 15 has a controller 306, a memory block 308, and a RF portion 304, including a receiver 342 and transmitter 344, for providing two-way communications through an antenna 302. The memory block 308 provides storage capability for the meter reading device 15. Data is stored in the memory block 308 for facilitating the operation of the meter reading device 15. This data may include addresses, or unit identifiers, for the meter interface units 12, group identifiers for the meter interface units 12, and other information needed to facilitate the meter reading system 10. Data may be pre-programmed in the meter reading device 15, or the data may comprise information, which is provided remotely via meter reading device 15. The data stored may also include transmission rules or specifiers therefor. The meter reading device 15 is capable of initiating communication with the group of remotely situated meter interface units 12 over one or more communication channels or radio frequency channels.

The meter reading device 15 initiates communications by transmitting a read request or a request for data addressed to a specific or target meter interface unit 12 or a group of meter interface units. The meter reading device 15 may transmit multiple requests before the target meter interface unit 12 is activated and responds. The meter reading device 15 waits to receive a message from the meter interface unit 12. The response sent by meter interface unit 12 contains meter status information. The meter reading device 15 is also capable of transmitting over the radio frequency communication channel to a group of meter interface units 12, a message containing a wake-up request, along with a group identifier in order to activate for an extended time, the group of meter interface units 12. Although not shown, the meter reading device can also include a display and keypad to allow a user more access to information from the remote meter interface devices 12 which are to be read. The meter reading device 15 is also operable to perform additional functions which are described below in the description of communications between the meter reading device 15 and one or more meter interface units 12.

In the preferred embodiment, the meter interface units 12 are activated upon detection of communication activity initiated by the meter reading device 15. To increase the likelihood that this communication activity will be detected, the time during which there are no transmission from the meter reading device 15 is minimized by requiring that meter interface units 12 transmit responsive data in segments. The meter reading device 15 transmits an acknowledgment on the communication channel thereby providing some communication activity for the remaining meter interface units 12 to detect in order to operate in an active state. Thus, transmission rules are provided which limit continuous transmission from meter interface units 12 thereby providing an opportunity for the meter reading device 15 to generate communication activity on the communication channel. This is an important aspect of the present invention. By providing a trade-off between communication activity on the communication channel generated by the meter reading device 15 and the number of transmissions which must be made by each meter interface unit 12, the total response time of the meter reading system can be improved. When all the meter interface units 12 remaining to be access are known to be operating in active state, the segmentation of transmission from each meter interface unit 12 is no longer necessary, and the transmission rule may be changed in order to facilitate transmissions of continuous streams of data from each meter interface unit 12 remaining to be accessed. In the preferred embodiment, the meter interface unit 12 has a default transmission rule which is in effect unless superseded by another transmission rule specified by the meter reading device 15. In another embodiment, the meter reading device 15 specifies a transmission rule with each transmission, and the meter interface unit 12 defaults to another transmission rule when none is specified by the meter reading device 15.

Figure 4:
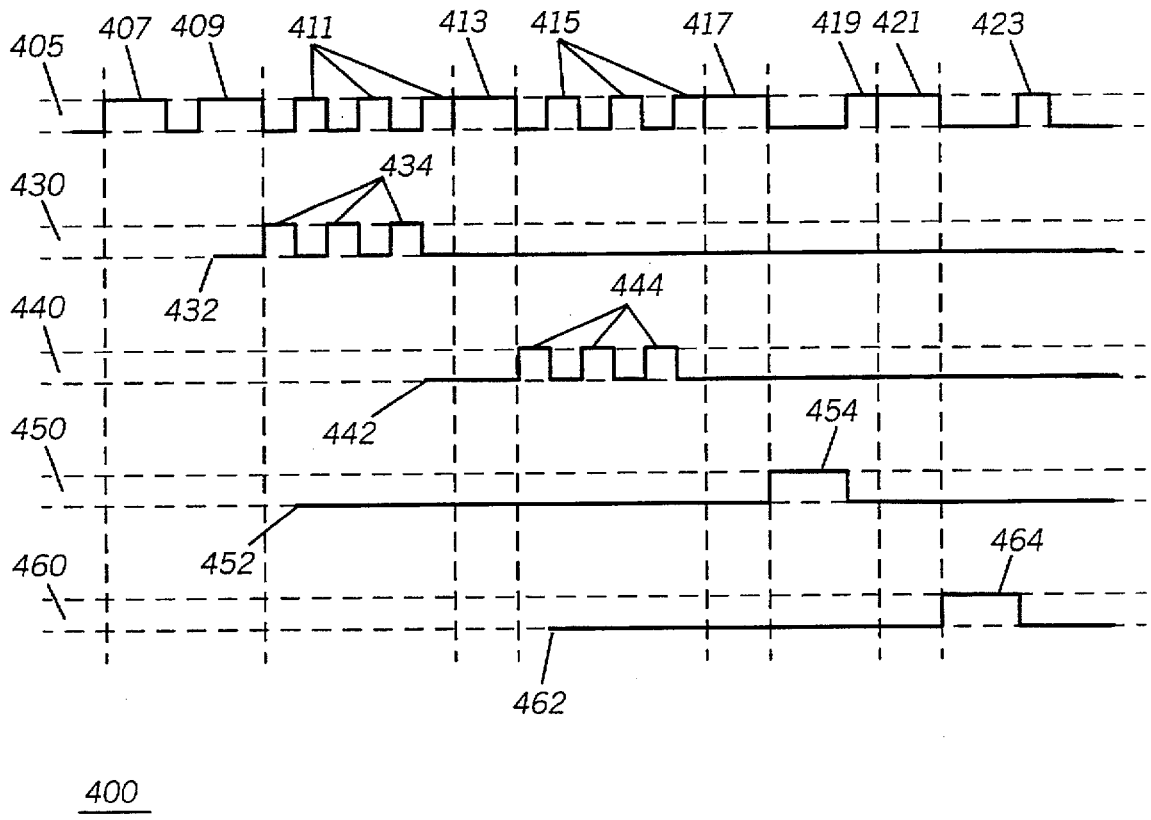
FIG. 4 shows a timing diagram representing communications between a group of meter interface units and the meter reading device, in accordance with the present invention.
Figure 5:
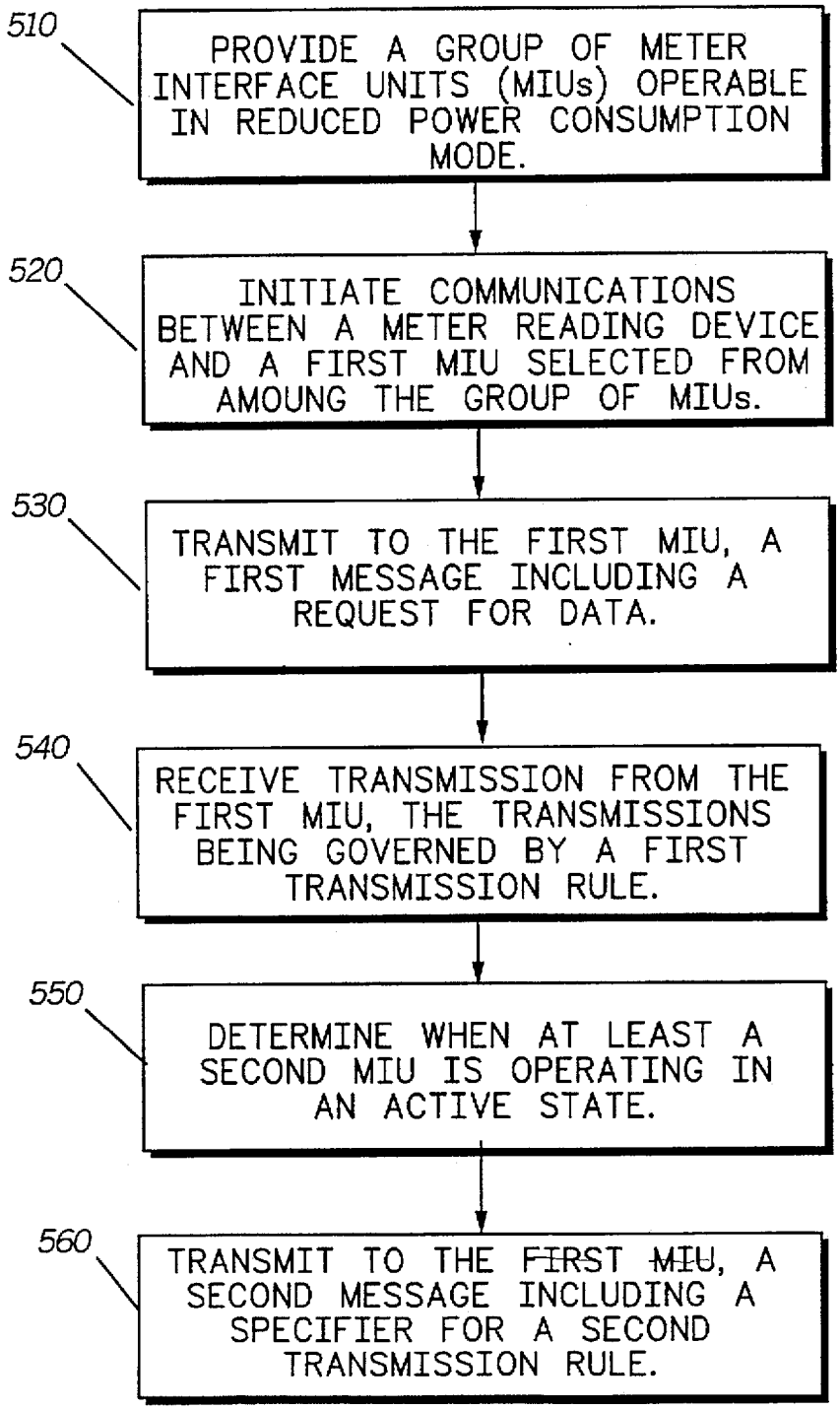
FIG. 5 shows a flowchart of procedures used to activate and access meter interface units, in accordance with the present invention.

Referring to FIGS. 4 and 5, the communication between the meter reading device and the group of meter interface unit will be described. FIG. 4 shows a timing diagram of representing communications between a group of meter interface units and the meter reading device, in accordance with the present invention. FIG. 5 shows a flowchart of procedures used to activate and access meter interface units, in accordance with the present invention. In FIG. 4, signal 405 represents receive and transmit activity of the meter reading device. Signals 430, 440, 450, and 460 represents received and transmit activity of first, second, third, and fourth meter interface units, respectively, selected from the among the group of interface units. Ordinarily, the group of meter interface units 12 is operable between an active and inactive state to reduce power consumption, step 510. Each meter interface unit 12 is periodically activated to monitor a communication channel for channel activity, and is responsive to communication signals from the meter reader device 15. To begin a meter reading session, the meter reading device 15 is located within communication range of the group of meter interface units 12. In the ensuing discussion, signal 405 represents the meter reading device 15, and signals 430, 440, 450, and 460 represent the first, second, third, and fourth meter interface units 12, respectively.

The meter reading device 405 initiates communication with a first meter interface unit 430 selected from among the group of meter interface units, step 520. Communications with the first meter interface unit 430 is initiated by transmitting on the communication channel a request, such as a read request containing an implicit wake-up request, or an explicit wake-up request to all meter interface units within range of the meter reading device 405. The request includes a unit identifier identifying, for example, the first meter interface unit. As shown in the timing diagram, the meter reading device 405 sends two requests or transmissions 407, 409 before receiving a response from the first meter interface unit 430. The first meter interface unit 430 is activated at time period 432 and detects communication activity on the communication channel originating from the meter reading device 405. The term "activated" in this context refers to the fact that the meter interface units 430, 440, 450, 460 monitor the communication channel in response to an applied time signal having, for example, 8 or 512 second intervals as described above, and detect channel activity. All meter interface units have independent timers, resulting in asychronous activation. The meter interface units also, however, share the same time signal interval, for example, 8 seconds, and thus each meter interface unit is checking the communications channel every 8 seconds. Thus, it can be concluded that after approximately 8 seconds all meter interface units within range of the meter reading device 405 will be "activated." The meter reading device 405 also transmits to the first meter interface unit 430, a first message on the communication channel including a request for data, step 530. Preferably, the first message includes the wake-up requests and the request for data.

In the preferred embodiment, the first message includes a specifier for a first transmission rule. The specifier may be a reference to a transmission rule stored at the first meter interface unit, or the specifier may be the transmission rule itself. The first transmission rule defines a limit, such as the maximum size of a data segment which can be transmitted by the meter interface unit. Additionally, the transmission rule may include a time limit for a continuous channel transmission, and a minimum value for a delay period between successive channel transmissions. In another embodiment, the transmission rule includes a size limit for a continuous stream of data in a transmission.

In response to the message requesting data from the meter reading device 405, the first meter interface unit 430 determines a data segmentation criteria based at least in part on the transmission rule specified in the transmission from the meter reading device 405, or stored in a data storage area accessible by the first meter interface unit 430. When the data responsive to the request for data can be transmitted without violating the applicable transmission rule, if any, the data is transmitted in a continuous stream. Otherwise, the data must be segmented in order to comply with the transmission rule.

The meter reading device 405 receives from the first meter interface unit 430, data segments in successive transmissions 434 in compliance with the first transmission rule, step 540. After each successive transmission, the meter reading device 405 transmits a message 411 acknowledging the transmission, and which may also include the first transmission rule or another transmission rule. The meter reading device 405 may also transmit a wake up request to one or more meter interface units between each successive transmission from the first interface unit. After the final data segment is received from the first meter interface 430 unit, the meter reading device 430 proceeds to a second meter interface unit 440 and the process is repeated.

The second meter interface unit becomes active at time period 442 and transmits data in successive transmissions 444 with the meter reading device 405. The meter reading device transmits an acknowledgment 415 acknowledging each successive transmission until all the data is received from the second meter interface unit. While the meter reading device 405 is accessing the first and second meter interface units 430, 440, the third meter interface unit 450 becomes active at time period 452, and the fourth meter interface unit 460 becomes active at time period 462. Thus, after the data from the second meter interface unit 440 has been retrieved, all the meter interface units 450, 460 remaining to be accessed are active.

After transmitting, the first and second meter interface units, comprising a first subgroup, are inactive. A second subgroup comprising the third and fourth meter interface units remain active. At this point, the meter reading device 405 transmits a message indicating that a second transmission rule should be used. Preferably, the meter reading device 405 transmits a specifier for a second transmission rule to the second subgroup of meter interface units. If a particular meter interface unit was currently transmitting under the first transmission rule, the second transmission rule would be transmitted to the particular meter interface unit to alter its behavior, step 560. However, the meter reading device 405 might have been including the first transmission rule with each transmission requesting or acknowledging data. In this case, the meter reading device 405 would cease to transmit the first transmission rule which would indicate that the meter reading device should default to a second transmission rule. In one embodiment, the second transmission rule indicates an absence of constraints imposed by the meter reading device 405 on continuous channel transmissions. In another embodiment, the second transmission rule indicates an absence of size limitation for a continuous stream of data. The third meter interface unit 450 may respond with data in a continuous stream without regard to any limitations imposed by the meter reading device 405 on a continuous channel transmission.

The meter reading device 405 transmits 417, and the third meter interface unit 450 receives, a request for data. The meter reading device 405 receives a responsive transmission 454 from the third meter interface unit 450 which includes all the data responsive to the request for data. The meter reading device then transmits an acknowledgment 419 to the third meter interface unit 450. Similarly, the meter reading device 405 transmits a request for data 421 and the second transmission rule to the fourth meter interface unit 460, and the fourth meter interface unit 460 provides an unrestricted response 464. The meter reading device 405 then transmits an acknowledgment 423, thereby completing the meter reading session.

Referring again to FIG. 1, the present invention provides for a meter reading system in which meter interface units, operable in a power consumption saving mode, can be accessed in a time efficient manner. In the preferred embodiment, the meter interface units 12 are periodically activated to monitor a communication channel for channel activity. Channel transmission rules are used to increase the likelihood that a meter interface unit 12 will detect channel activity generated by the meter reading device 15 during the periodic activation. Consequently, a meter reading session can proceed more quickly, while still facilitating power conservation. A more efficient meter reading session will typically result in a reduction in overall operation costs.

What is claimed is:

1. In a remote meter reading system including a group of meter interface units wherein each meter interface unit is operable in either an active or an inactive state to reduce power consumption, wherein each meter interface unit is periodically activated to monitor a communication channel for channel activity, and is responsive to communication signals from a meter reading device, a method of activating and accessing a group of meters, comprising the steps of:

at the meter reading device:

initiating communication with a first meter interface unit selected from among the group of meter interface units;

transmitting on the communication channel a first message to the first meter interface unit;

receiving transmissions from the first meter interface unit, the transmissions being governed by a first transmission rule;

transmitting, to the first meter interface unit, a second message indicating a second transmission rule when at least a second meter interface unit is operating in an active state.

2. The method of claim 1, wherein the step of initiating communication with a first meter interface unit selected from among the group of meter interface units, includes the step of:

transmitting a wake-up request including a unit identifier identifying the first meter interface unit.

3. The method of claim 1, wherein the step of transmitting on the communication channel a first message to the first meter interface unit, includes the step of:

transmitting a request for data.

4. The method of claim 1, wherein the step of transmitting on the communication channel a first message to the first meter interface unit, includes the step of:

transmitting a specifier for a first transmission rule as part of the first message.

5. The method of claim 4, wherein the step of transmitting a specifier for a first transmission rule as part of the first message, includes the step of:

transmitting a size limit for a continuous stream of data in a transmission.

6. The method of claim 4, wherein the step of transmitting a specifier for a first transmission rule as part of the first message, includes the step of:

transmitting a time limit for a continuous channel transmission.

7. The method of claim 6, wherein the step of transmitting a specifier for a first transmission rule as part of the first message, further includes the step of:

transmitting a minimum value for a delay period between successive channel transmissions as part of the first transmission rule.

8. The method of claim 1, further comprising the steps of:

at the first meter interface unit:

dividing data responsive to the first message from the meter reading device into first and second data segments; and transmitting the first and second data segments in successive transmissions to the meter reading device.

9. The method of claim 8, wherein the step of dividing data responsive to the first message from the meter reading device into first and second data segments, comprises the step of:

determining a data segmentation criteria based at least in part on a transmission rule specified in a transmission from the meter reading device.

10. The method of claim 8, wherein the step of dividing data responsive to the first message from the meter reading device into first and second data segments, comprises the step of:

determining a data segmentation criteria from a transmission rule stored in data storage area accessible by the first meter interface unit.

11. The method of claim 1, wherein the step of receiving transmissions from the first meter interface unit, the transmissions being governed by a first transmission rule, comprises the steps of:

at the meter reading device:

receiving data segments in successive transmissions from the first meter interface unit in compliance with the first transmission rule; and transmitting a message after each successive transmission from the first meter interface unit.

12. The method of claim 11, wherein the step of transmitting a message after each successive transmission from the first meter interface unit, includes the step of:

at the meter reading device, transmitting a wake-up request to at least the second meter interface unit.

13. The method of claim 11, wherein the step of transmitting, to the first meter interface unit, a second message indicating a second transmission rule when at least the second meter interface unit is operating in an active state, includes the step of:

specifying a transmission rule indicating an absence of a size limitation imposed by the meter reading device for a continuous stream of data.

14. The method of claim 1, further comprising the step of:

at the meter reading device, transmitting the first transmission rule when transmitting to the first meter interface unit until at least the second meter interface unit is operating in an active state.

15. The method of claim 1, wherein the step of transmitting, to the first meter interface unit, a second message indicating a second transmission rule when at least the second meter interface unit is operating in an active state, includes the step of:

specifying a transmission rule indicating an absence of constraints imposed by the meter reading device on continuous channel transmissions.

16. In a remote meter reading system including a group of meter interface units wherein each meter interface unit is operable in either an active or an inactive state to reduce power consumption, wherein each meter interface unit is periodically activated to monitor a communication channel for channel activity, and is responsive to communication signals from a meter reading device, a method of accessing a group of meters, comprising the steps of:

at the meter reading device:

initiating communication with a first meter interface unit selected from among the group of meter interface units;

transmitting to the first meter interface unit, a first message on the communication channel the first message including a request for data and a specifier for a first transmission rule, the first transmission rule indicating a limit for continuous channel transmissions;

at the first meter interface unit:

dividing data responsive to the request for data from the meter reading device into at least first and second data segments;

transmitting the first and second data segments in successive transmissions to the meter reading device, the transmissions being governed by the first transmission rule;

at the meter reading device:

transmitting a message after each successive transmission from the first meter interface unit, the message including a wake-up request to at least a second meter interface unit;

transmitting to the first meter interface unit a second message indicating a second transmission rule when at least the second meter interface unit is operating in an active state, the second transmission rule indicating an absence of constraints on channel transmissions.

17. A meter reading device for communicating with first and second meter interface units, the meter interface units being operable between active state and an inactive state to reduce power consumption, the meter reading device comprising:

a controller, an electrically coupled memory portion, an electrically coupled transmitter, an electrically coupled receiver, and an electrically coupled antenna cooperating to transmit to the first meter interface unit a first message including a request for data, and to receive successive transmissions from the first meter interface transmitted under a first transmission rule, and to transmit a specifier for a second transmission rule to the first meter interface unit when the second meter interface unit is operating in an active state.

18. A remote meter reading system, comprising:

a plurality of remotely accessible meter interface units wherein:

each meter interface unit is operable in an inactive state to reduce power consumption, and is periodically operable in an activated state to monitor a communication channel for channel activity, each meter interface unit being responsive to a wake-up request for operating in an activated state for an extended time period, and being responsive to requests for data; and a meter reading device, comprising:

means for initiating communication with a first meter interface unit selected from among the group of meter interface units;

means for transmitting to the first meter interface unit, a first message on the communication channel including a request for data;

means for receiving transmissions from the first meter interface unit, the transmissions being governed by a first transmission rule;

means for transmitting to the first meter interface unit, a second message including an indication for a second transmission rule when at least the second meter interface unit is operating in an active state.

19. A remote meter reading system, comprising:

first and second meter interface units wherein:

each meter interface unit is operable in an inactive state to reduce power consumption, and is periodically operable in an activated state to monitor a communication channel for channel activity, each meter interface unit being responsive to a wake-up request for operating in an activated state for an extended time period, and being responsive with successive transmissions to requests for data; and a meter reading device, comprising:

a controller, an electrically coupled memory portion, an electrically coupled transmitter, an electrically coupled receiver, and an electrically coupled antenna cooperating to transmit to the first meter interface unit a first message including a request for data, and to receive successive transmissions from the first meter interface transmitted under a first transmission rule, and to transmit a specifier for a second transmission rule to the first meter interface unit when the second meter interface trait is operating in an active state.

* * * * *